US006412420B1

(12) United States Patent
Kramer et al.

(10) Patent No.: US 6,412,420 B1
(45) Date of Patent: Jul. 2, 2002

(54) CABLE BY-PASS DEVICE AND SYSTEM

(75) Inventors: Rafael Kramer, Glenview, IL (US); Anne Jahnke, Cedar Rapids, IA (US)

(73) Assignee: Sellstrom Manufacturing Co., Palatine, IL (US)

( * ) Notice: Subject to any disclaimer, the term of this patent is extended or adjusted under 35 U.S.C. 154(b) by 0 days.

(21) Appl. No.: 09/680,896

(22) Filed: Oct. 6, 2000

(51) Int. Cl.[7] ..... B61B 12/12

(52) U.S. Cl. ..... 104/182; 104/115; 104/87; 104/235

(58) Field of Search ..... 104/182, 87, 235, 104/115; 182/5, 192; 105/151

(56) References Cited

U.S. PATENT DOCUMENTS

| | | | | | |
|---|---|---|---|---|---|
| 506,037 | A | * | 10/1893 | Forbes | 104/182 |
| 904,119 | A | * | 11/1908 | Downs | 104/182 |
| 1,106,471 | A | * | 8/1914 | Opsal | 104/182 |
| 1,122,024 | A | * | 12/1914 | O'Connell | 104/182 |
| 3,799,503 | A | | 3/1974 | Desplats | |
| 4,438,659 | A | | 3/1984 | Desplats | |
| 4,462,316 | A | * | 7/1984 | Tupper | 105/151 |
| 4,560,098 | A | | 12/1985 | Tupper | |
| 4,584,945 | A | | 4/1986 | Tupper | |
| 4,593,447 | A | | 6/1986 | Tupper | |
| 4,846,075 | A | * | 7/1989 | Tupper | 104/204 |
| 4,905,606 | A | | 3/1990 | Tupper | |
| 4,960,402 | A | * | 10/1990 | Klein et al. | 474/80 |
| 5,127,338 | A | | 7/1992 | Flux | |
| 5,934,408 | A | | 8/1999 | Flux | |
| 6,125,766 | A | * | 10/2000 | Flux | 104/182 |

* cited by examiner

*Primary Examiner*—S. Joseph Morano
*Assistant Examiner*—Frantz F. Jules
(74) *Attorney, Agent, or Firm*—Mayer Brown Rowe & Maw

(57) ABSTRACT

Disclosed herein is cable by-pass device comprising a guide wheel rotatably mounted to an axle, at least one toothed wheel having a plurality of teeth extending radially therefrom rotatably mounted independently of the guide wheel, a bracket to the rear of the guide wheel, and an attachment portion below the guide wheel.

21 Claims, 9 Drawing Sheets

CABLE BY-PASS DEVICE AND SYSTEM

BACKGROUND OF THE INVENTION

1. Field of the Invention

The present invention relates to a cable by-pass device. Particularly, the present invention is directed to a cable by-pass device that allows a user to move along a cable having obstructions without disconnecting the device.

2. Description of Related Art

A variety of devices are known for permitting a user to navigate along a cable, such as an elevated line. However, many such devices suffer from the critical deficiency of needing to be disengaged when encountering an obstruction, such as an intermediate anchorage and the like.

To overcome this deficiency, some devices utilize a toothed wheel and a threading means, wherein the cable is threaded through the threading means and the obstructions in the cable are passed over through the gaps between the teeth of the toothed wheel. Some such devices may further include an attachment means for attaching to a load, a lanyard or a safety harness.

The prior devices, however, have suffered from one or more critical deficiencies. Many of the prior by-pass devices use an unsuitable or unreliable threading means to attach the device to the cable being navigated. For example, many by-pass devices require the user to thread a terminal end of the cable through a jacket or slipper on the device. Such a threading means is unsuitable, therefore, if the cable being navigated has already been secured to a structure or is continuous.

In addition, the load-bearing portions of many prior devices are often inherently too weak to be of safe and satisfactory use. For example, one variety of prior cable by-pass devices includes grooves at the distal end of the teeth on the toothed wheel for engaging the cable being navigated. These grooves may not be strong enough to hold the cable if the cable is slick or deformed to the weight of the load attached to the device (or in some cases the device itself). Still other prior cable by-pass devices utilize such grooves to engage flanges on a threading means. In those devices, the grooves may still not provide a strong enough connection between the device and the cable.

Typically, the threading means commonly utilized in the prior cable by-pass devices described above are designed so that the device is made to hang from the cable being navigated. This configuration has the inherent deficiency of adding the weight of the device and any potential load to the portion of the device through which the cable is threaded. These devices must be manufactured with the additional necessary strength in mind, often resulting in either a heavier and more cumbersome device, or an unsafe device that may be incapable of supporting more massive loads.

There thus remains a need for a suitable cable by-pass device that overcomes the deficiencies of the prior art.

SUMMARY OF THE INVENTION

The purpose and advantages of the present invention will be set forth in and apparent from the description that follows, as well as will be learned by practice of the invention. Additional advantages of the invention will be realized and attained by the devices and alternative embodiments particularly pointed out in the written description and claims hereof, as well as from the appended drawings.

A feature of an embodiment of the present invention is a guide wheel rotatably mounted about an axle. Another feature of an embodiment of the present invention is an arcuate surface about the perimeter of the guide wheel. In operation in accordance with the preferred embodiment, the guide wheel freely rotates over the cable being navigated. An advantage of the preferred embodiment of the present invention is that a user may move along a cable with a minimum of friction or wear and tear on the device. A further advantage of the preferred embodiment of the present invention is that the load is primarily borne by the sturdy guide wheel and axle.

Yet another feature of an embodiment of the present invention is a toothed wheel rotatably mounted independently of the guide wheel, wherein the toothed wheel comprises a plurality of teeth extending radially therefrom. In operation, as the device rolls over the cable via the guide wheel, anchor points or obstructions in the cable pass through the gaps between the teeth without requiring the user to disconnect the device from the cable or disconnect himself from the device. An advantage of the preferred embodiment of the present invention is that a user may navigate cable in a variety of circumstances.

A further feature of an embodiment of the present invention is a guide wheel that may be rotatably mounted in front of a bracket, which in use is positioned to the rear of the cable being navigated, and wherein the teeth of the toothed wheel are to the front of the cable to prevent the cable from slipping off of the guide wheel. Another feature of an embodiment of the present invention is an attachment portion below the guide wheel. An advantage of the preferred embodiment of the present invention is that the by-pass device may be loaded onto the cable at different portions along the length thereon.

In brief, an embodiment of the invention is a cable by-pass device comprising a guide wheel rotatably mounted to an axle; at least one toothed wheel rotatably mounted independently of the guide wheel; a bracket to the rear of the guide wheel; and an attachment portion below the guide wheel. In other embodiments, the guide wheel and toothed wheel both rotate about the same axle. In yet another embodiment, the by-pass device further comprises a second axle. In further embodiments, the toothed wheel rotates on a second axle. Further embodiments include a first toothed wheel in front of the guide wheel and a second toothed wheel between the guide wheel and the bracket. In other embodiments, the toothed wheel rotates about a lower axle, and the teeth of the toothed wheel extend to a point proximate to and in front of the guide wheel and opposing teeth extend to a point proximate the attachment portion. Other embodiments include a back plate between the guide wheel and the bracket. In addition, the guide wheel may be provided with an arcuate surface about its perimeter.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the preferred embodiments of the invention. Together with the description, the drawings serve to explain the principles of the invention.

DETAILED DESCRIPTION OF THE PREFERRED EMBODIMENT

Reference will now be made in detail to the present preferred embodiments of the invention, examples of which are illustrated in the accompanying drawings.

Figure 1:
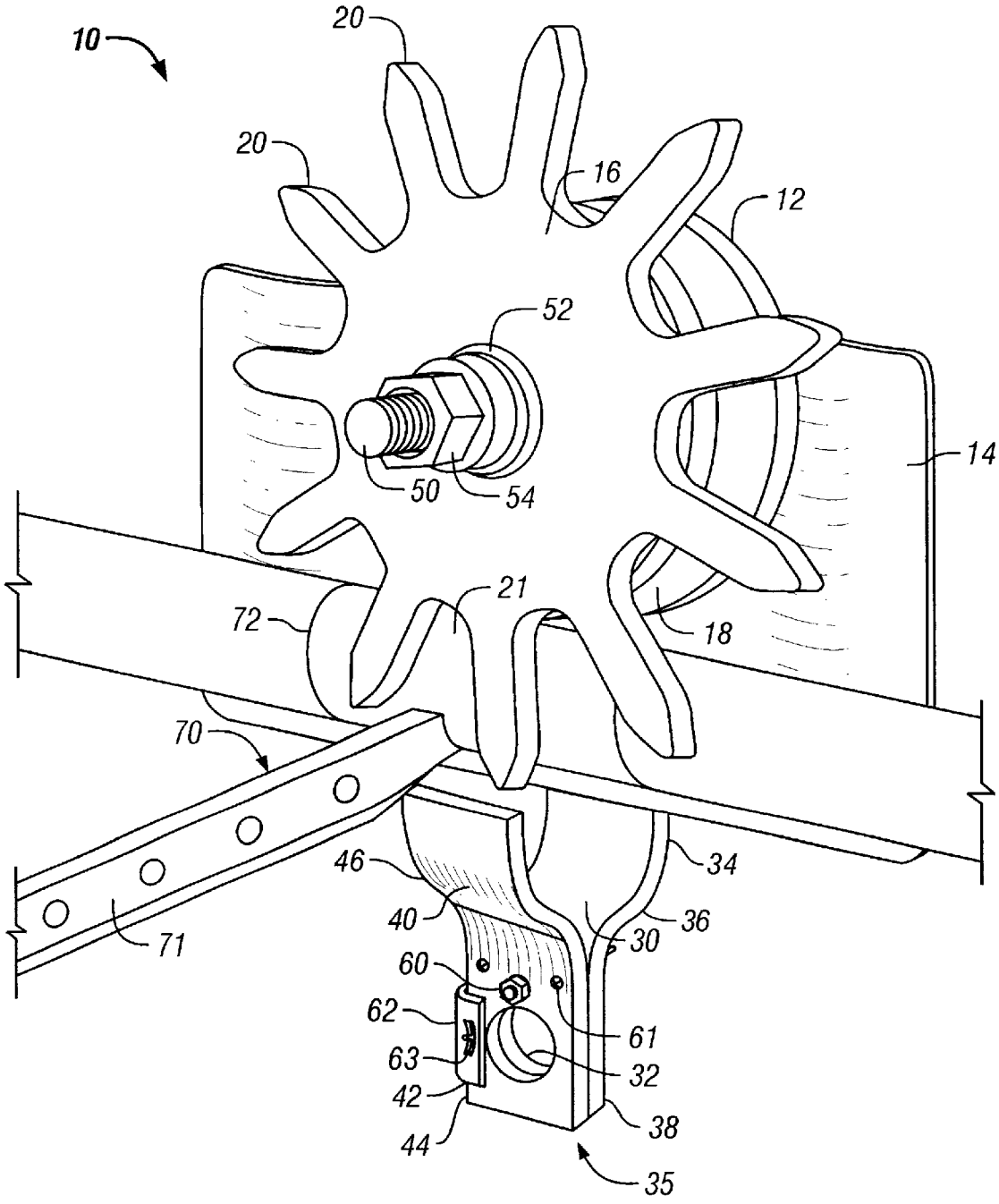
FIG. 1 is a perspective view of an embodiment the invention.

For purpose of explanation and illustration, and not limitation, an exemplary embodiment of the cable by-pass device in accordance with the invention is shown in FIG. 1 and is designated generally by reference character 10.

As shown in FIG. 1, the by-pass device 10 generally includes a back plate 14, a guide wheel 12, a toothed wheel 16, a bracket 30, and a locking element 40. In the preferred embodiment, each of the back plate 14, guide wheel 12, toothed wheel 16, bracket 30 and locking element 40 are made of a strong rigid material such as, but not limited to, aluminum or stainless steel.

Figure 3:
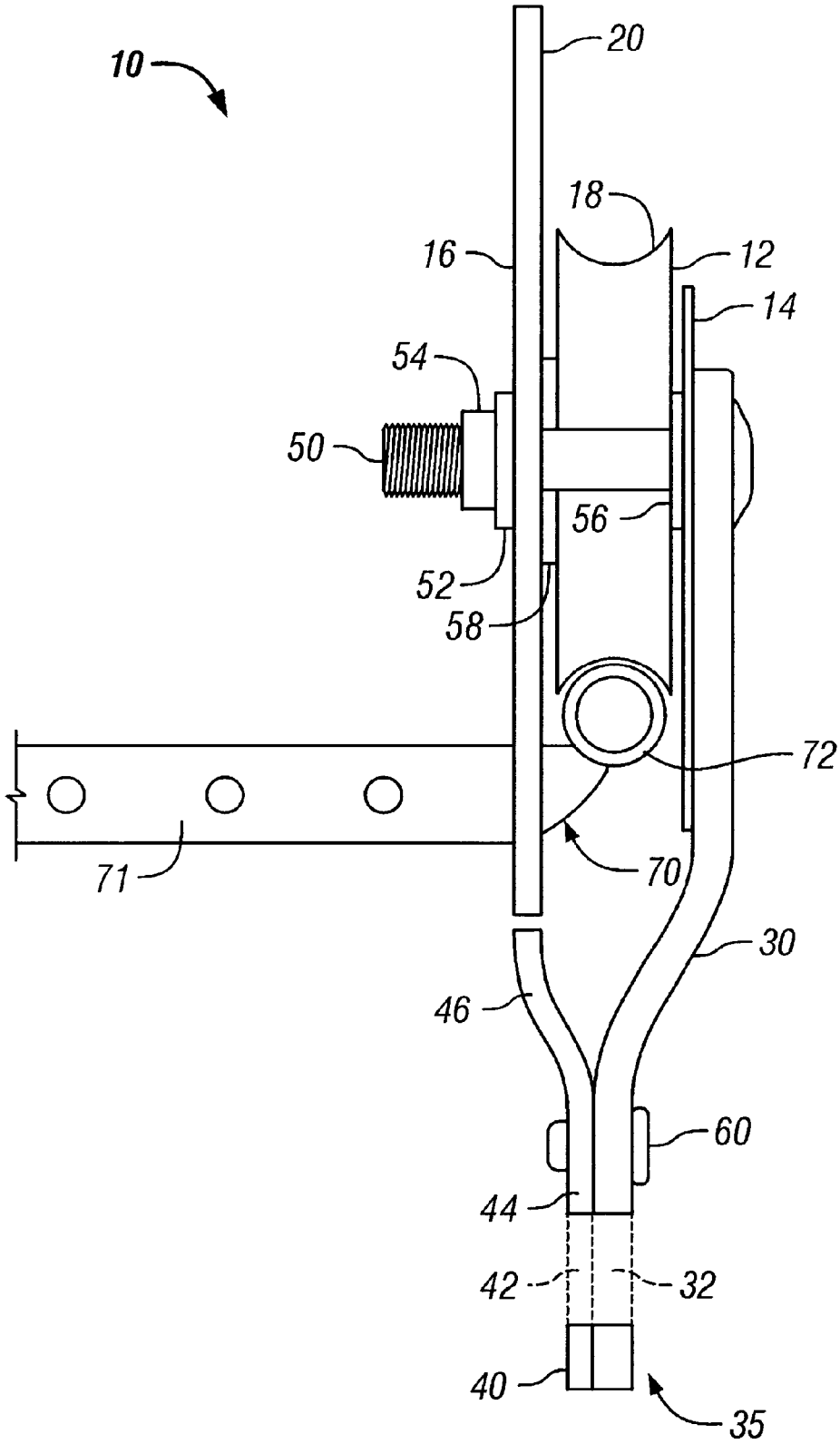
FIG. 3 is a cross-sectional view along the line A—A of FIG. 2.

The guide wheel 12 is rotatably mounted to an axle 50 which extends, in the preferred embodiment, from the back plate 14 and through the bracket 30. In FIG. 3, the axis member 50 is welded to the bracket 30 and extends through an opening in the back plate 14. The back plate 14 may be attached to the bracket 30 via a number of suitable means, such as, without limitation, welding, screwing, or other mechanical attachment. Preferably, although not necessarily, the axis member 50 is made of a strong, rigid material such as aluminum or steel. In alternative embodiments, the axis member 50 may be a partially threaded insert through an opening in the bracket 30 and back plate 14, wherein the insert is attached by tightening a nut on the rear of the bracket 30.

The back plate 14 helps to stabilize the device 10 and hinder slippage of the cable off of the rear of the guide wheel 12. In addition, the back plate 14 and the bracket 30 contribute to the tolerance of the device 10 for rotation about a cable. Specifically, as a load attached to the device 10 swings back and forth beneath the cable, such as, for example, due to wind or other incidental forces, the back plate 14 and bracket 30 permit the device a safe degree of rotation by keeping the guide wheel 12, and hence the device 10, engaged on top of the cable and preventing slippage. However, the cable by-pass device according to the present invention can be used without a back plate 14 without departing from the scope of the present invention.

The guide wheel 12 is mounted on the axis member 50. The guide wheel 12 may be made of a strong, rigid material such as aluminum, steel, plastic or the like. In the preferred embodiment, the guide wheel 12 is provided with an arcuate surface 18 about its perimeter. The axial width of the guide wheel 12, and hence the size of the arcuate surface 18 may be specially manufactured to fit a specified diameter cable, or may be manufactured with sufficient curvature or width to adapt to virtually any size cable. In operation, as the guide wheel 12 rolls over the cable, the guide wheel 12 rotates about the axis member 50 and reduces the frictional forces between the cable and the device that may erode both the device and the cable being navigated. As a result, the cable by-pass device according to embodiments of the present invention may be used with a variety of cables, including cables made of steel, plastic, or other synthetic materials.

The device 10 further comprises a toothed wheel 16 having a plurality of teeth 20 extending radially therefrom. In the preferred embodiment, although not necessarily, the teeth are equally spaced. In the present embodiment, the toothed wheel 16 is placed on the axis member 50, in front of the guide wheel 12 relative to the back plate 14. In other embodiments, a second toothed wheel may be utilized between the guide wheel 12 and the back plate 14 or bracket 30. It is preferred, although not required, that a spacer 58 be placed between the guide wheel 12 and toothed wheel 16 to allow the two wheels to rotate independently about the axis member 50 and to reduce friction between the parts. Independent rotation may also be achieved by use of a separate axle, as described further below. Other constructions allowing independent rotation of the toothed wheel 16 may also be achieved. In the present embodiment, the toothed wheel 16 is then fastened with a washer 52 and nut 54 to allow the toothed wheel 16 to freely rotate about the axis member 50.

The device 10 further comprises a bracket 30 to the rear of the guide wheel 12. In a preferred embodiment, the bracket 30 is positioned to the rear of the back plate 14 and is attached thereto by welding, screwing, or other mechanical means. In other embodiments, the bracket 30 may be formed as a part of the back plate 14. The bracket 30 may also be of any desired width parallel to the back plate 14, including without limitation, wider than the back plate 14. The bracket 30 may also be of any thickness, width or length desired to account for weight, strength, balance of the device or other design factors that would be apparent to one skilled in the art.

In one embodiment of the device 10, the bracket 30 comprises an intermediate angled portion 36 and a lower portion 38 parallel to the back plate 14. In that embodiment, the shape of the bracket 30 is manipulated to allow the user to attach a load to the device at a point directly below the guide wheel 12, and hence the cable being navigated. In that instance, superior balance and stability of the device can be achieved. Balance and stability of the device 10 may also be achieved without the use of an angled bracket 30 such as, without limitation, including counter-weights on the end of the axis member 50 or adjusting the weight of the toothed wheel 16. Other methods for achieving balance and stability will be readily apparent to those skilled in the art, and each is intended to be within the scope of the present invention.

The device 10 also comprises an attachment portion 35 below the guide wheel 12. In the present embodiment, the attachment portion 35 includes a locking element 40 to reduce the risk of accidentally attaching a load prior to engagement of the device 10 to the cable being navigated. In the preferred embodiment, the locking element 40 is mounted to the bracket 30 and comprises an upper portion 46 and a lower portion 44. In a preferred embodiment, the locking element 40 is rotatably mounted to the bracket 30 via a nut and bolt 60. The upper portion 46 extends to a point proximate the perimeter of the toothed wheel 16 to minimize any gap which would permit the device 10 to slip out from under the cable. In alternative embodiments, the upper portion 46 of the locking element 40 may extend past the perimeter of the toothed wheel 16. In operation, the locking element 40 may be turned to one side to allow the device 10 to be rear loaded onto the cable. Once the cable is set beneath the guide wheel 12 in front of the back plate 14, the locking element 40 is rotated to close the gap in the front of the cable.

Figure 2:
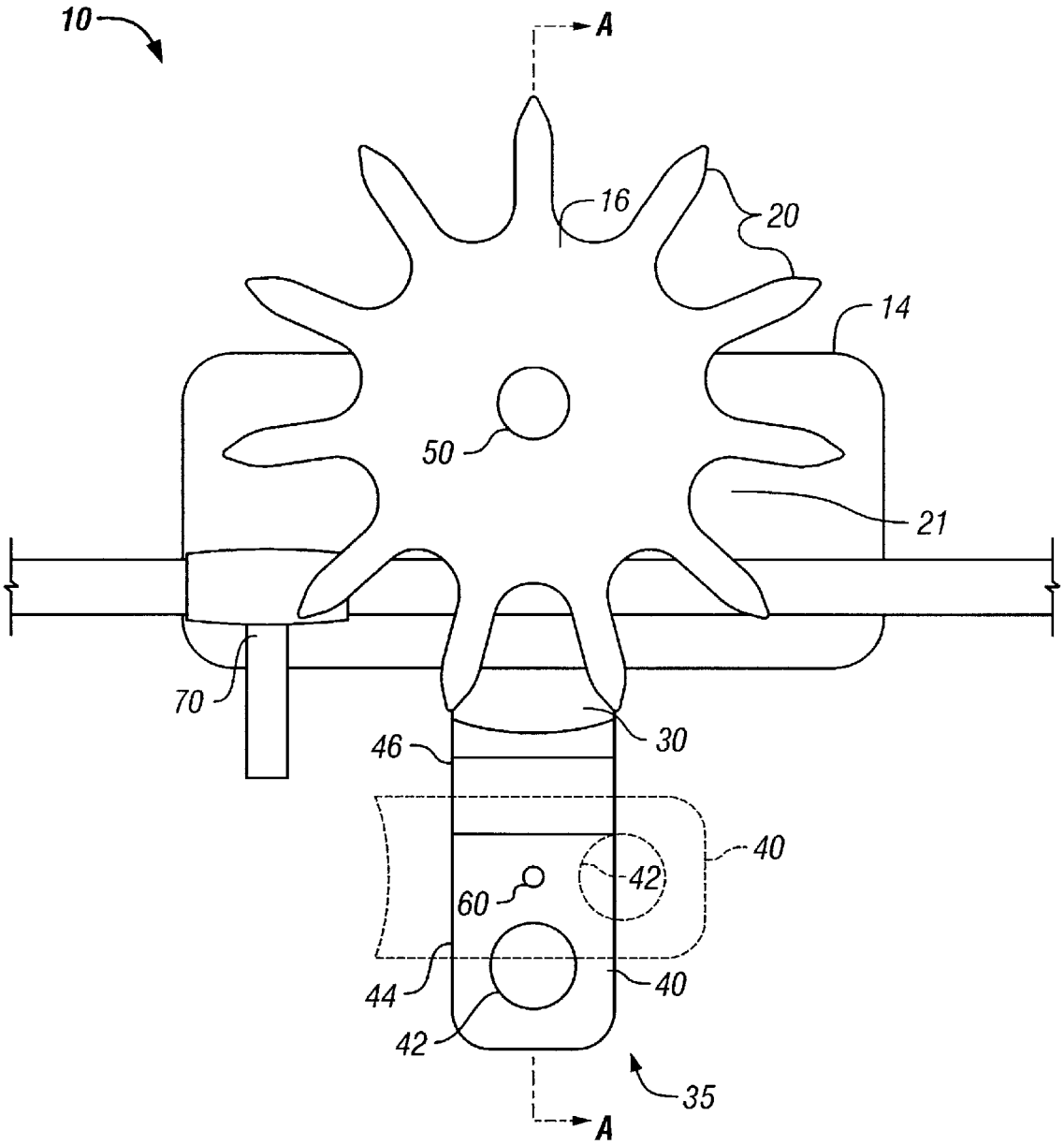
FIG. 2 is a f front view of an embodiment of the present invention.

In one embodiment of the present invention, the locking element 40 cooperates with the bracket 30 to ensure that the device 10 has engaged the cable prior to attaching a load to the by-pass device 10. In a preferred embodiment, the lower portion 44 of the locking element 40, and the lower portion 38 of the bracket 30, have holes 42, 32, respectively. When the locking element 40 closes, the locking element 40 and the bracket 30 are aligned, creating an opening through the holes 42, 32. As seen in FIG. 2, when the locking element 40 is turned (such as prior to or during placement of the device 10 on the cable), the holes 42, 32 are misaligned, the opening between the holes disappears, and the device 10 cannot easily be attached to a load. In this manner, a user cannot accidentally attach a load (including himself) to the device 10 before the device 10 has safely engaged the cable. In addition, the presence of a hook or other attachment device inhibits rotation of the locking element 40.

In alternative embodiments, removable pins 53 may be inserted through holes in the locking element 40 and bracket 30 to keep the locking element from opening while the device 10 is in use. In yet other embodiments, the device 10 may comprise a clamp 62, such as a c-clamp or the like, having a bolt and nut 63 therein to clamp and hold the locking element 40 and bracket 30 in place.

Figure 4:
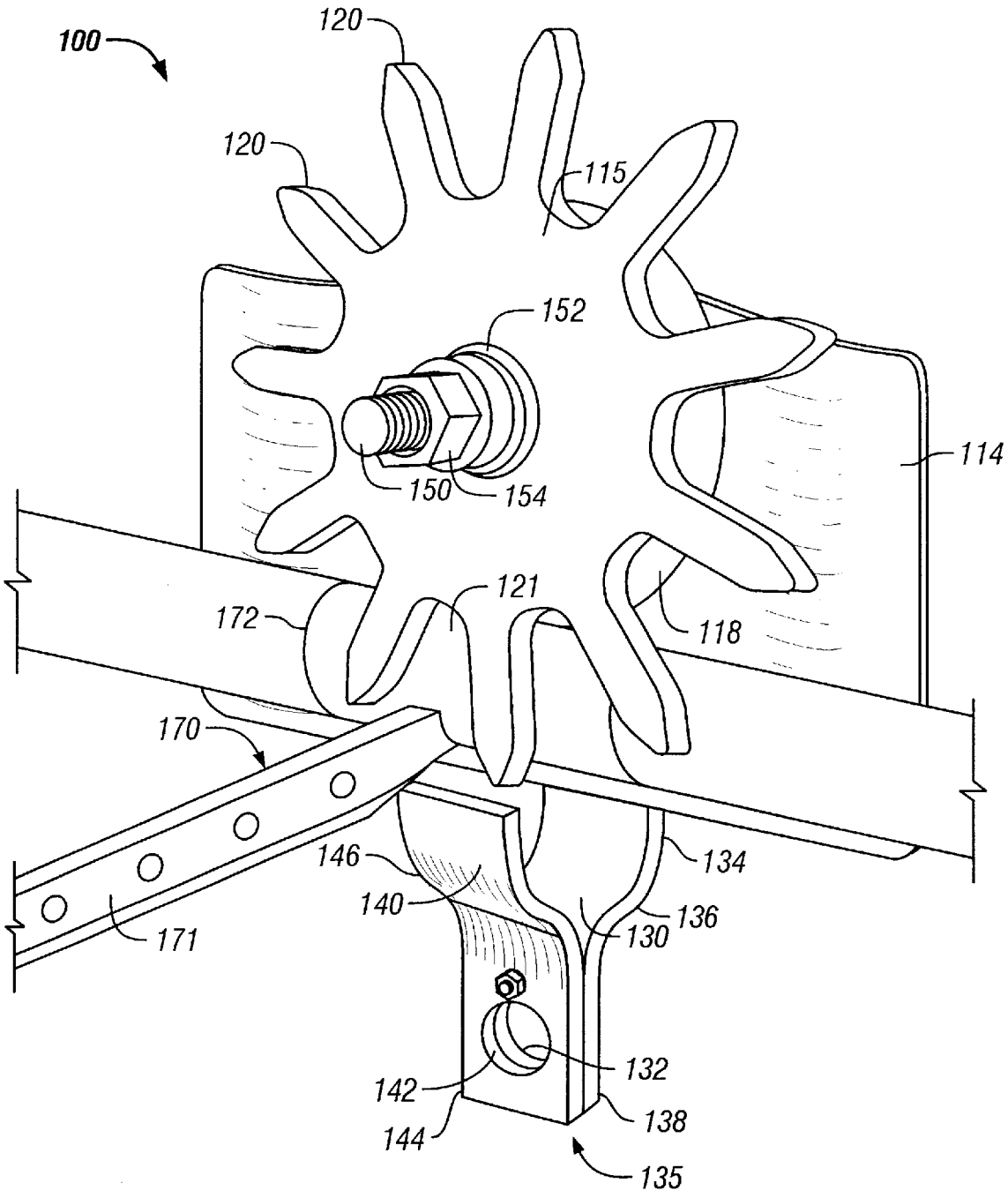
FIG. 4 is a perspective view of an embodiment of the invention.
Figure 5:
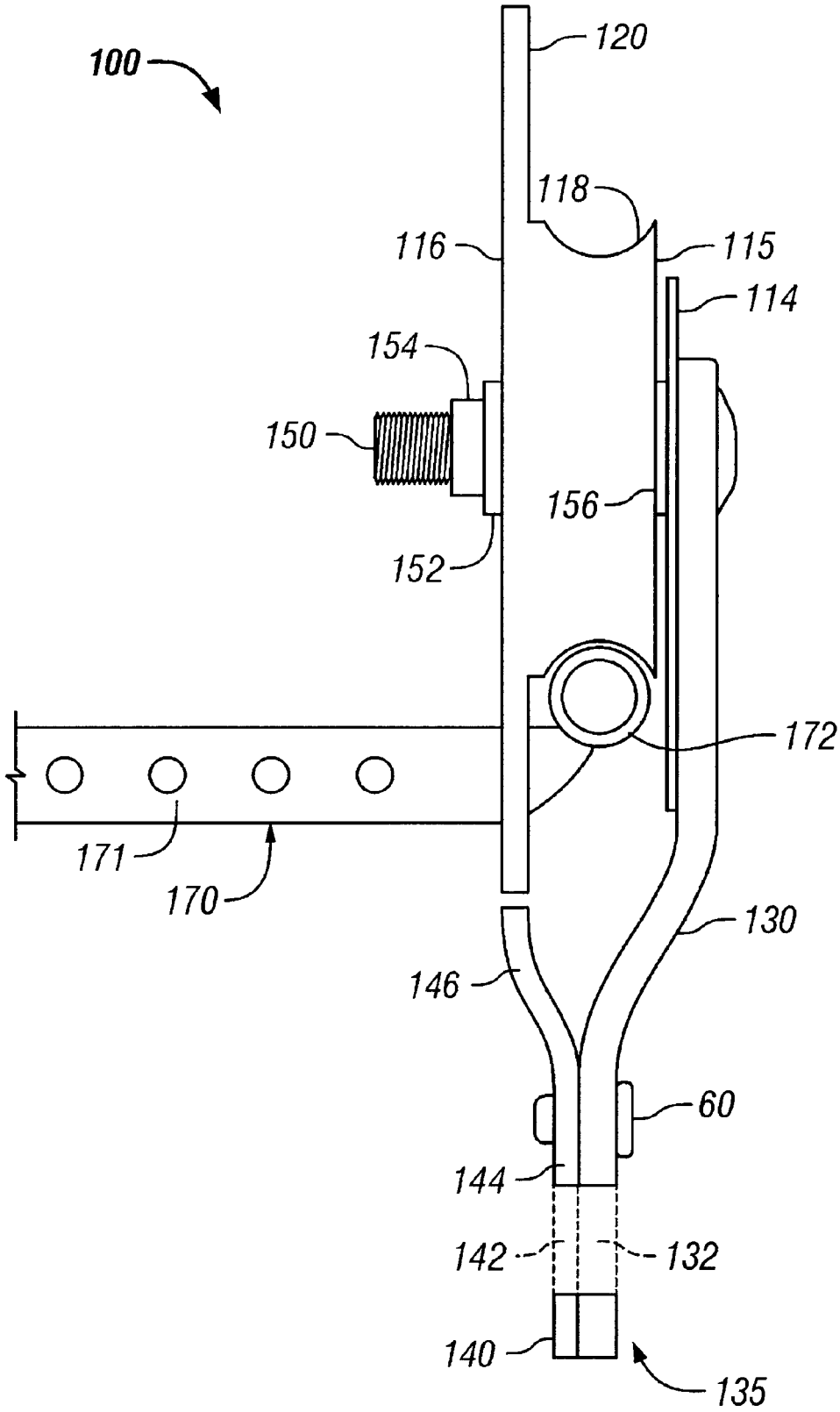
FIG. 5 is a cross-sectional view of the embodiment of FIG. 4.

FIG. 4 and FIG. 5 illustrate another embodiment of the present invention. The cable by-pass device 100 according to this embodiment comprises a single wheel 115 rotatably mounted to an axis 150, in front of a back plate 114, the wheel 115 having an arcuate surface 118 along a portion of its axial length, and having a plurality of equally spaced teeth 120 extending radially from the front face thereof. The wheel 115 is placed upon an axis member 150, preferably with a washer 156 between it and the back plate 114, and a washer 152 and nut 154 on its front.

Figure 6:
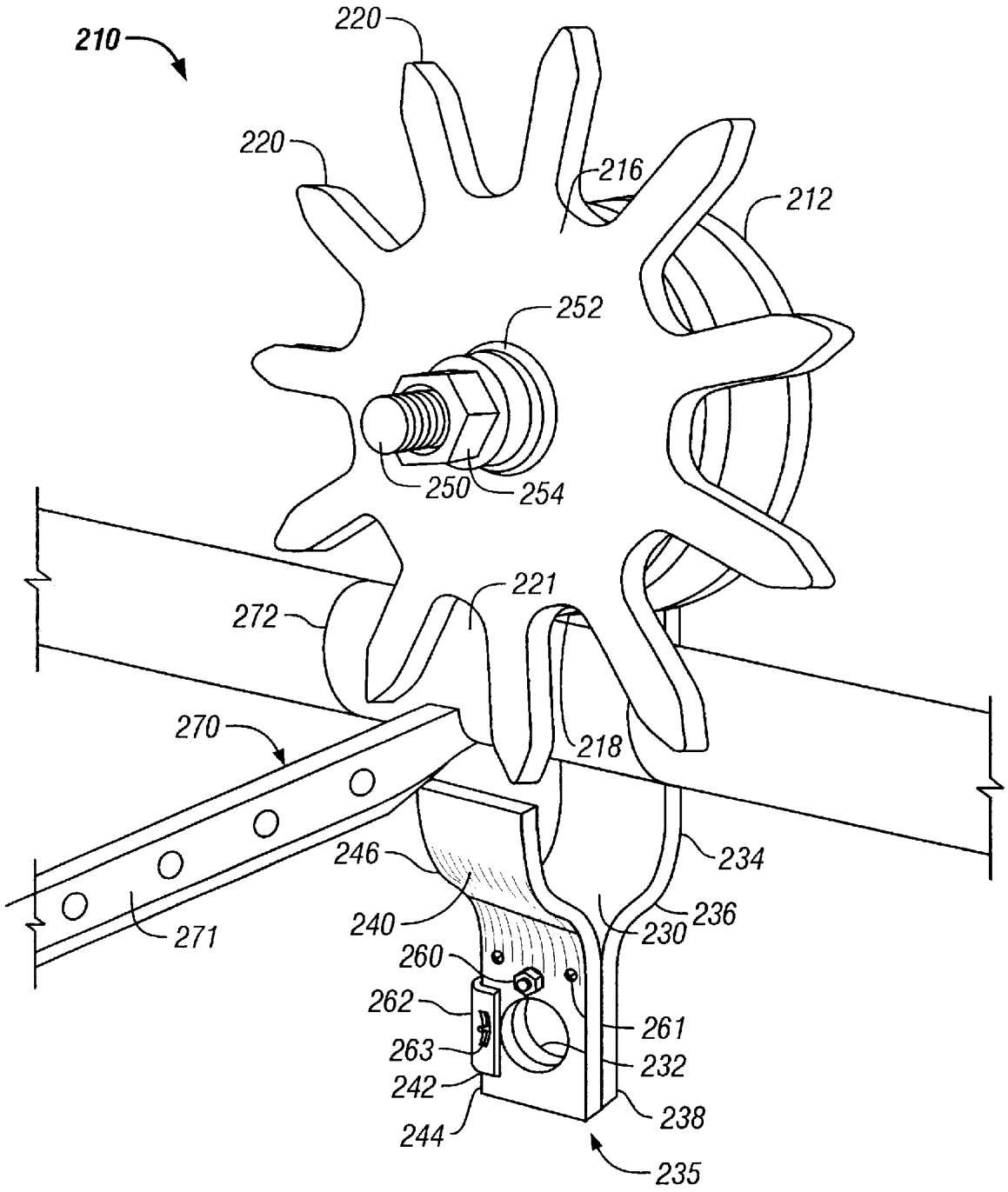
FIG. 6 is a perspective view of an embodiment of the invention.

The embodiments of the present invention can also be modified to remove the back plate 14. FIG. 6 depicts one such embodiment according to the present invention. In FIG. 6, the device 210 is provided without a back plate. In this embodiment, the guide wheel 212 and toothed wheel 216 are rotatably mounted to an axis 250. The axis 250 is attached to the bracket 234 to the rear of the guide wheel 212, as has been previously described. The bracket 230 depends downward from the axis 250 and comprises, in one embodiment, an intermediate angled portion 236 and lower portion 238 parallel to the wheels 212, 216. The upper portion of the bracket 234, and the teeth 220 and locking mechanism 240, provide an enclosure for the cable to prevent the cable from slipping out from under the guide wheel 212.

Figure 7:
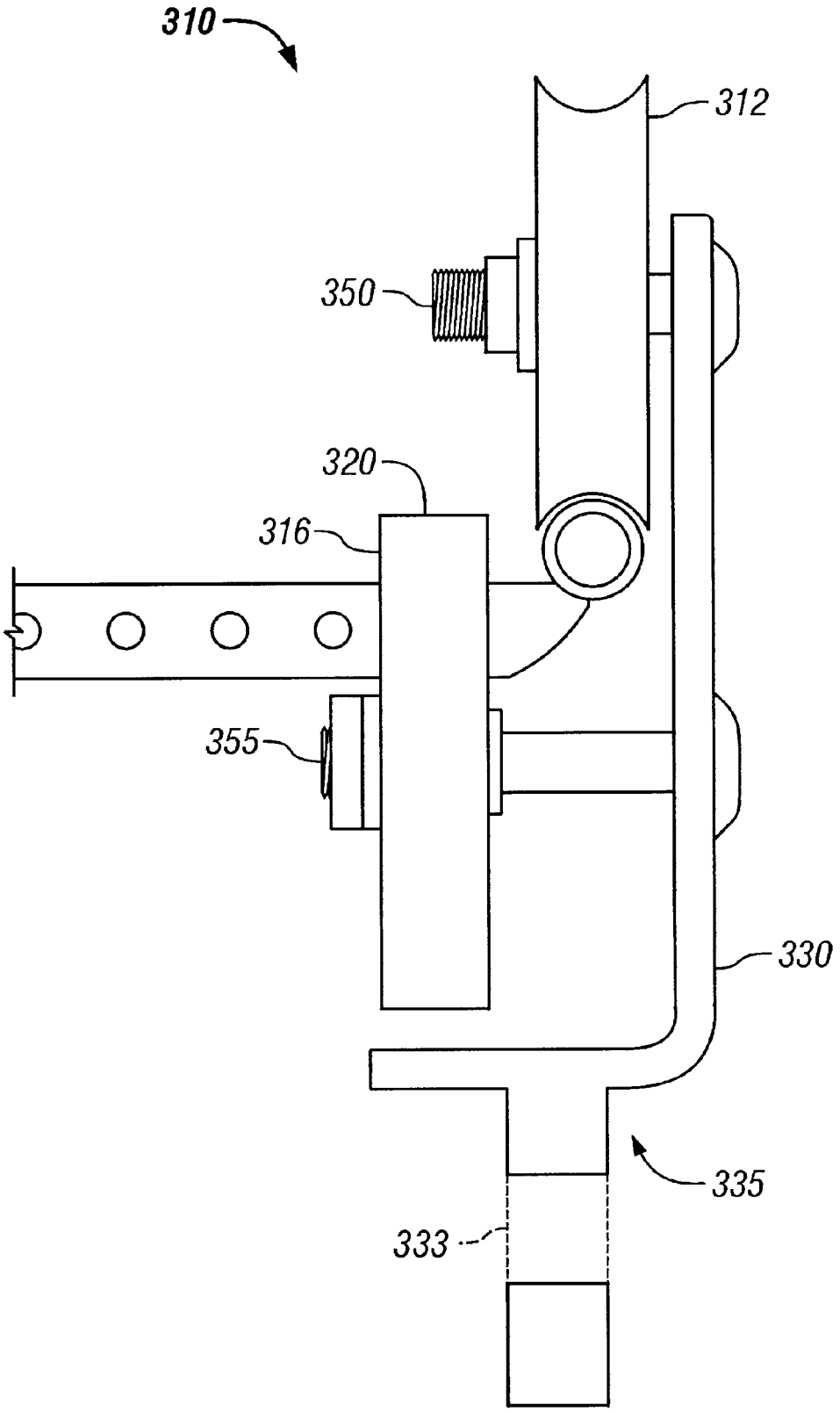
FIG. 7 is a cross-sectional view of another embodiment of the invention.
Figure 8:
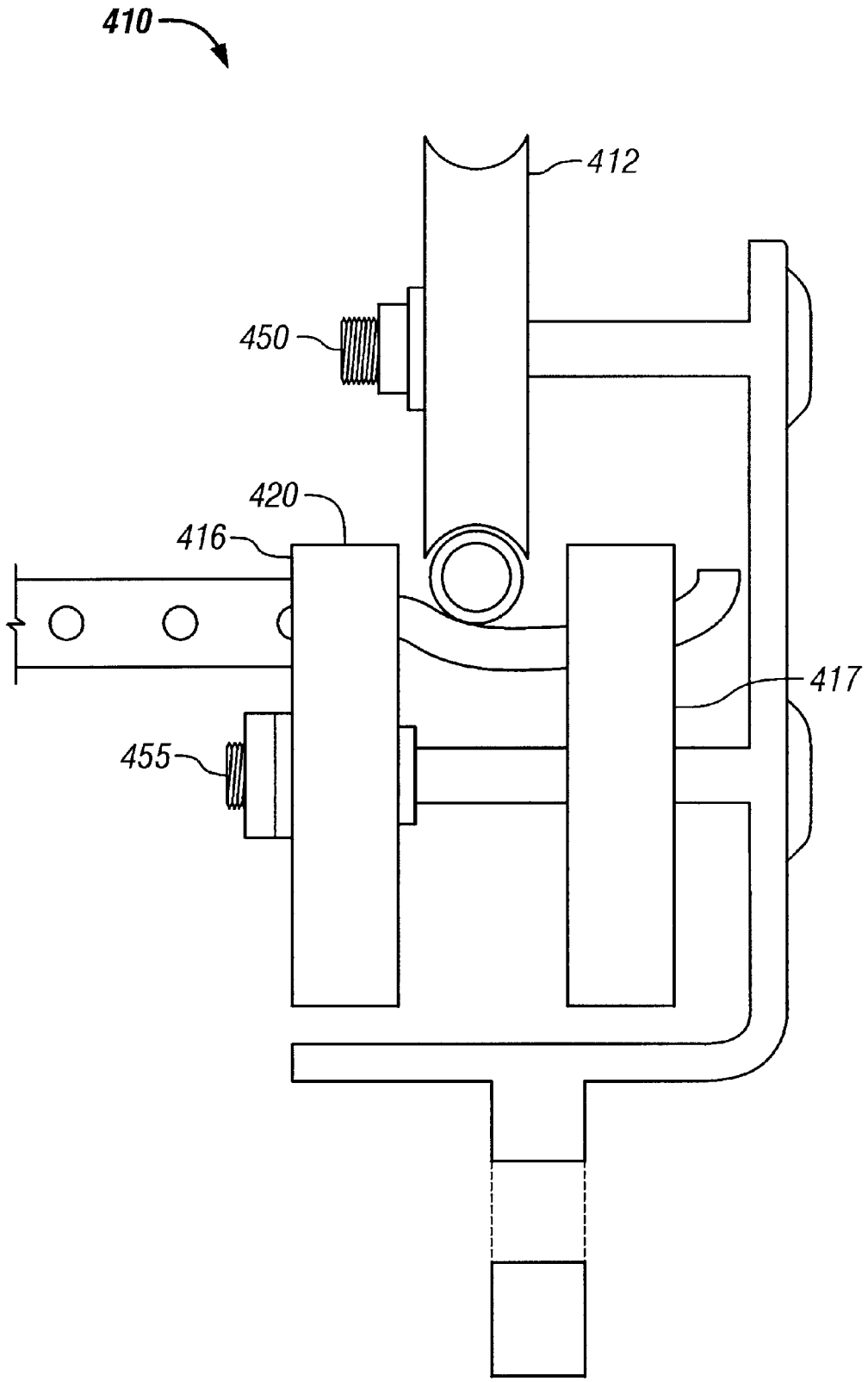
FIG. 8 is a cross-sectional view of another embodiment of the invention.

FIG. 7 depicts yet another embodiment of the present invention. In FIG. 7, the device 310 comprises a guide wheel 312 rotatably mounted to a first axle 350. The device 310 further comprises a second axle 355 below the guide wheel axle 350. In this embodiment, a toothed wheel 316 is rotatably mounted on the second axle 355. The teeth 320 of the toothed wheel 316 extend to a point proximate to and in front of the guide wheel 312, to form an enclosure in front of the cable being navigated. In FIG. 8, the present embodiment is modified to include a second toothed wheel 417 rotatably mounted on the second axle 455 between the guide wheel 412 and the bracket 430.

The attachment portion is also capable of many embodiments in addition to the multi-part construction described with respect to FIG. 1. In FIG. 7, the attachment portion 335 of the device 310 is formed as a lower portion of the bracket 330. In the device 310, a section of the bracket 330 is angled to a point below the guide wheel 312, wherein the teeth 320 of the toothed wheel 316 extend to a point proximate the attachment portion 335, creating an enclosure for the cable. The attachment portion 335 further includes a lower section which may contain a hole 333 therein for attachment. It should be understood that the attachment portion 335 described in reference to FIG. 7 may be utilized with any of the embodiments of the present invention.

Figure 9:
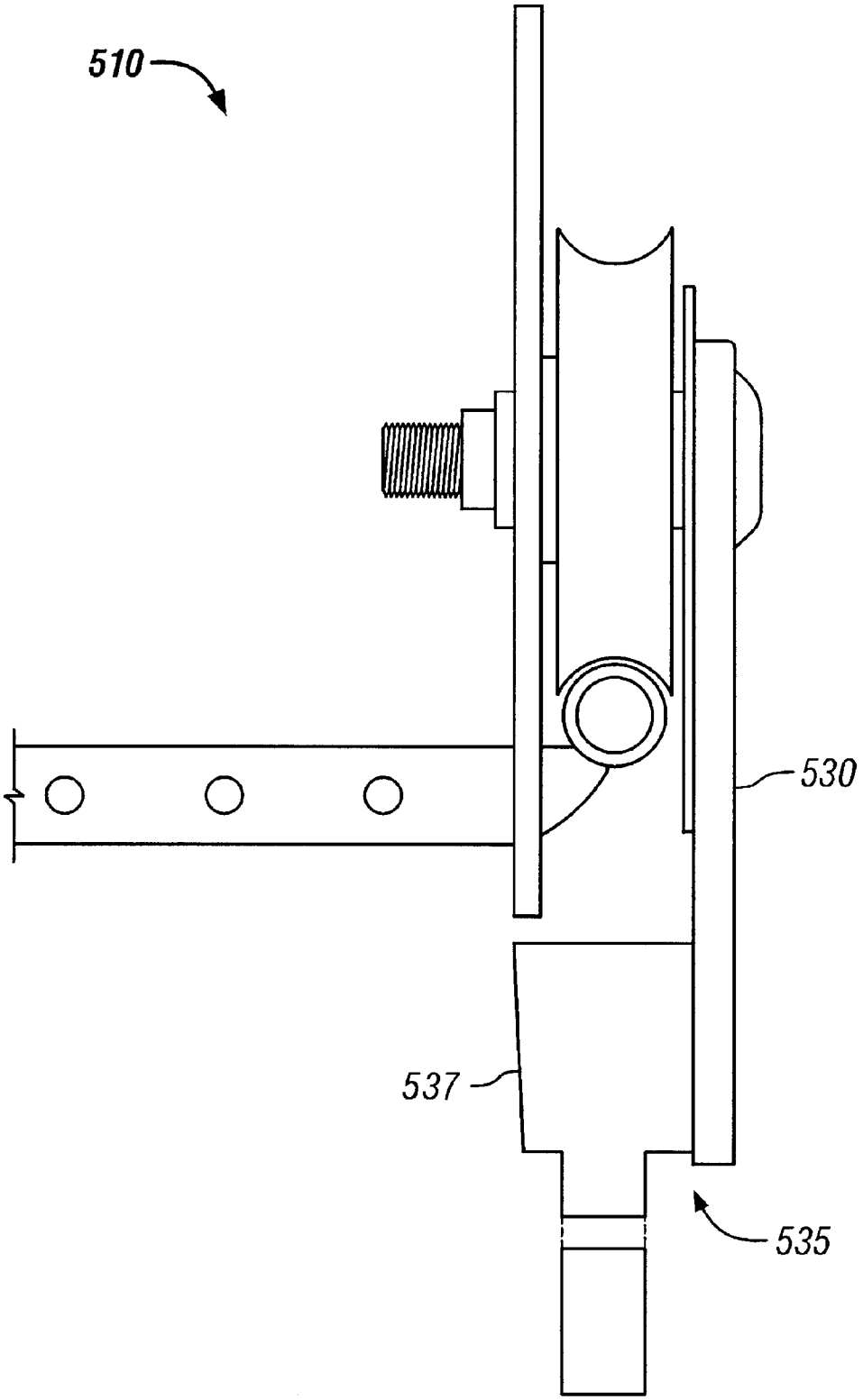
FIG. 9 is a cross-sectional view of another embodiment of the invention.

In FIG. 9, the attachment portion 535 of the device 510 comprises a piece 537 secured to the bracket 530 by a suitable secure means, such as welding or other mechanical fastening known in the art. The piece 537 further includes a hole therein for attachment.

Referring to FIG. 1 for illustrative purposes, the embodiments of the present invention described herein are particularly suitable for bracket-type intermediate anchorages 70. However, it should be apparent, and it is intended, that the present invention be used with all types of line obstructions, including without limitation, hooks, knots, transverse cables and the like. The intermediate anchorage 70 comprises an arm portion 71 and a cable-housing portion 72. Typically, such intermediate anchorages 70 support a cable at some distance away from a structure. Hence, the arm portion 71 is attached at its terminal end to a wall, ledge or other structure by any secure means, and the cable is threaded through the cable-housing portion 72. The cable-housing portion 72 should approximate the contours of the cable as in, without limitation, a cylindrical or barrel shape. The intermediate anchorages 70, therefore, permit a cable to be supported at intermediate points along a path. The present invention permits the user to navigate along the cable and by-pass the intermediate anchorages 70.

The operation of the cable by-pass device of the present invention will now be described with reference to FIG. 1. It should be understood, however, that the description herein applies to each of the embodiments disclosed herein, as well as other that would be apparent to those with skill in the art. In operation, the device 10 is placed onto the cable to be navigated as described above. In embodiments utilizing a locking element, the locking element 40 is closed, and the user may attach a line, hook, harness, or other attachment devices to the device 10 through the opening created by the alignment of the holes 32, 42. The guide wheel 12 (or the single wheel 115 with respect to the embodiment described in FIGS. 4 and 5, which like parts shall be parenthetically referred to herein) rolls along the cable. When an obstruction such as intermediate anchorage 70 (170) is encountered in the cable, the obstruction 70 (171) is by-passed by permitting the guide wheel 12 (115) to roll over the cable-housing portion 72 (172) and permitting the arm portion 71 (171) to move into the space 21 (121) between the teeth 20 (120) The guide wheel 12 (115) continues to roll over the cable as the teeth 20 (120) of the toothed wheel 16 (115) are engaged by the arm portion 71 (171). The obstruction 70 (170) is then by-passed through the space 21 (121) between the teeth 20 (120) of the toothed wheel 16 (115) while the guide wheel 12 (115), and hence the device 10 (100), continue to remain attached to the cable.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

What is claimed is:

1. A cable by-pass device comprising:

a wheel rotatably mounted to an axis, the wheel having a plurality of teeth extending radially from a front face thereof;

a bracket to the rear of the wheel; and an attachment portion below the wheel and integrated with the bracket;

wherein the wheel is adapted to roll over a cable being traversed.

2. The cable by-pass device of claim 1 wherein the attachment portion comprises a lower portion of the bracket.

3. The cable by-pass device of claim 2 wherein the attachment portion comprises a section of the bracket angled to a point below the wheel and a lower section of the bracket extending downward from the angled section.

4. The cable by-pass device of claim 1 wherein the teeth extend to a point proximate the attachment portion.

5. The cable by-pass device of claim 1 further comprising a hole on the attachment portion.

6. The cable by-pass device of claim 1 further comprising a back plate between the wheel and the bracket.

7. A cable by-pass device comprising:

a guide wheel rotatably mounted to an axle;

at least one toothed wheel having a plurality of teeth extending radially therefrom rotatably mounted independently of the guide wheel;

a bracket to the rear of the guide wheel; and an attachment portion below the guide wheel.

8. A cable by-pass device comprising:

a guide wheel rotatably mounted to an axle and adapted to roll over a cable being traversed;

at least one toothed wheel having a plurality of teeth extending radially therefrom rotatably mounted independent of the guide wheel;

a bracket to the rear of the guide wheel; and an attachment portion below the guide wheel and integrated with the bracket.

9. The cable by-pass device of claim 7 wherein the guide wheel has an arcuate surface along its axial length.

10. The cable by-pass device of claim 7 wherein the toothed wheel is mounted in front of the guide wheel.

11. The cable by-pass device of claim 7 wherein there are two toothed wheels.

12. The cable by-pass device of claim 11 wherein a first toothed wheel is mounted in front of the guide wheel and a second toothed wheel is mounted between the guide wheel and the bracket.

13. The cable by-pass device of claim 7 further comprising a second axle.

14. The cable by-pass device of claim 13 wherein the second axle is below the guide wheel axle.

15. The cable by-pass device of claim 13 wherein the toothed wheel is mounted to the second axle.

16. The cable by-pass device of claim 13 wherein the teeth of the toothed wheel extend to a point proximate to and in front of the guide wheel, and wherein opposing teeth of the toothed wheel extend to a point proximate to the attachment portion.

17. The cable by-pass device of claim 13 further comprising a first toothed wheel mounted an the second axle to the front of the guide wheel, and a second toothed wheel mounted to the second axle between the guide wheel and the bracket.

18. The cable by-pass device of claim 7 wherein the attachment portion comprises a section of the bracket angled to a point below the wheel and a lower section of the bracket extending downward from the angled section.

19. The cable by-pass device of claim 7 further comprising a hole on the attachment portion.

20. The cable by-pass device of claim 7 further comprising a back plate between the guide wheel and the bracket.

21. A cable by-pass device comprising:

a guide wheel rotatably mounted to an axle;

a at least one toothed wheel having a plurality of equally spaced teeth extending radially therefrom rotatably mounted independently of the guide wheel;

a bracket to the rear of the guide wheel;

a back plate between the guide wheel and the bracket;

an attachment portion comprising a section of the bracket angled to a point below the guide wheel and a lower section of the bracket extending downward from the angled section.

* * * * *